US007329086B2

(12) United States Patent
Wiebe et al.

(10) Patent No.: US 7,329,086 B2
(45) Date of Patent: Feb. 12, 2008

(54) ROTOR SHAFT, IN PARTICULAR FOR A GAS TURBINE

(75) Inventors: Markus Roland Wiebe, Freienwil (CH); Thomas Kramer, Ennetbaden (CH); Holger Kiewel, Brugg (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 11/386,497

(22) Filed: Mar. 22, 2006

(65) Prior Publication Data

US 2007/0086884 A1 Apr. 19, 2007

(30) Foreign Application Priority Data

Mar. 23, 2005 (CH) ..... 0504/05

(51) Int. Cl.
*F01D 25/12* (2006.01)

(52) U.S. Cl. ..... 415/115

(58) Field of Classification Search ..... 415/115; 416/96 R, 97 R
See application file for complete search history.

(56) References Cited

U.S. PATENT DOCUMENTS 2,575,568 A * 11/1951 Topanelian, Jr. ..... 96/217
4,344,738 A * 8/1982 Kelly et al. ..... 416/95
4,522,562 A * 6/1985 Glowacki et al. ..... 416/95
4,818,182 A 4/1989 Bouru ..... 416/215
5,507,620 A * 4/1996 Primoschitz et al. ..... 416/96 R
5,957,660 A 9/1999 Evans et al. ..... 416/97 R
6,082,962 A * 7/2000 Drosdziok et al. ..... 415/115
6,195,979 B1 * 3/2001 Fukuyama ..... 60/806
6,237,558 B1 5/2001 Ergezen et al. ..... 123/195 R
6,478,539 B1 11/2002 Trutschel ..... 415/223 R

FOREIGN PATENT DOCUMENTS

| | | |
|---|---|---|
| DE | 30 47 514 A1 | 10/1981 |
| DE | 29 47 521 A1 | 6/1986 |
| DE | 37 13 923 A1 | 11/1987 |
| DE | 44 28 207 A1 | 2/1996 |
| EP | 0 814 233 A2 | 12/1997 |
| EP | 0 859 127 A1 | 8/1998 |
| EP | 0 945 594 A1 | 9/1999 |
| EP | 1 234 949 A2 | 8/2002 |
| GB | 2 189 845 A | 11/1987 |
| GB | 2 265 671 A | 10/1993 |

* cited by examiner

*Primary Examiner*—Ninh H. Nguyen
(74) *Attorney, Agent, or Firm*—Darby & Darby

(57) ABSTRACT

A rotor shaft, particularly for a gas turbine, includes a cooling air supply disposed inside the rotor shaft and a plurality of cooling air ducts connected to the cooling air supply and extending essentially radially outward toward an outside of the shaft, wherein each of the cooling air ducts has an elliptic cross section.

12 Claims, 3 Drawing Sheets

ROTOR SHAFT, IN PARTICULAR FOR A GAS TURBINE

Priority is claimed to Swiss Patent Application No. CH 00504/05, filed on Mar. 23, 2005, the entire disclosure of which is incorporated by reference herein.

The present invention relates to the field of rotating machines. It refers to a rotor shaft, in particular for a gas turbine.

BACKGROUND

Where machines subjected to high thermal and mechanical load are concerned, such as for example, compressors, gas turbines or steam turbines, it is desirable to reduce mechanical stresses by means of a suitable design of the individual machine and plant parts.

Thus, from the prior art, it is known, for example (see EP-A1-0 945 594 or U.S. Pat. No. 6,478,539 B1), in the moving blades of gas turbines, to design the transition from the blade leaf to the adjoining blade platform lying beneath it with a predetermined, preferably elliptic curvature contour, the major axis running in the radial direction and the minor axis being oriented parallel to the surface of the platform.

Furthermore, it is known from U.S. Pat. No. 6,237,558 B1 to provide specific locations of the crankcase of an internal combustion engine which are critical in terms of mechanical stresses with a curvature which follows a conic section (ellipse, hyperbola, parabola).

Not only the moving blades of turbines are exposed to high mechanical loads on account of the high rotational speeds, but also the rotor shaft itself. Critical locations are in this case, above all, the grooves in the rotor shaft which are arranged on the outer circumference and which, running in the axial direction or running around annularly, may be provided, for example, for receiving the blade roots of the moving blades or as part of a shaft seal. Where such grooves are concerned, the stresses arising in the groove depend critically on the cross-sectional contour. GB-A-2 265 671 or U.S. Pat. No. 4,818,182 discloses grooves running around annularly for the fastening of moving blades, said grooves having a rounded cross-sectional contour. No information is given on the nature of the curvature profile or on the influence of the contour on the stresses in the groove.

In the rotor parts subjected to particularly high thermal load, the turbine part, additional cooling measures are often provided, in order, at the high hot-gas temperatures, to achieve a sufficient service life of the material used. Cooling measures of this kind include cooling air ducts which run approximately in the radial direction from the inside outward through the rotor shaft and lead cooling air from an inner cooling air supply to the surface of the rotor shaft. Cooling air ducts of this type, however, constitute mechanical weakenings of the rotor shaft which may have an adverse effect in the case of the high temperatures and centrifugal forces and under the changing loads.

SUMMARY OF THE INVENTION

An object of the present invention is to provide such a rotor shaft equipped with radial cooling air ducts, in such a way that the weakenings of the rotor shaft due to the cooling air ducts are minimized or at least markedly reduced.

The present invention provides a rotor shaft, in particular for a gas turbine, in which cooling air ducts are provided, which run from the inside outward essentially in the radial direction and are connected to a cooling air supply present inside the rotor shaft, characterized in that the cooling air ducts have an elliptic cross section for the reduction of mechanical stresses.

A refinement of the invention is characterized in that the cooling air ducts are arranged so as to be distributed over the circumference of the rotor shaft, and in that the elliptic cross section of the cooling air ducts is in each case oriented such that the major axis is oriented in the circumferential direction and the minor axis is oriented in the axial direction.

Preferably, the rotor shaft has a compressor part and a turbine part, and the cooling air ducts are arranged in the turbine part.

Another refinement of the invention is distinguished in that the turbine part has a plurality of rotor disks arranged one behind the other in the axial direction, for the fastening of moving blades, and in that the cooling air ducts are arranged between adjacent rotor disks.

In particular, it is conceivable that cavities are formed, concentrically with respect to the rotor axis, inside the rotor shaft, and that the cooling air ducts emanate from at least one of the cavities and are connected to the cooling air supply via this cavity. It is then especially beneficial that the cavities have, at least partially, an elliptic cross-sectional contour on the outer circumference for the reduction of mechanical stresses, preferably the cross-sectional contour on the outer circumference being composed of two elliptic segments of two ellipses which are tilted with respect to one another and the major axes of which are oriented approximately in the radial direction.

BRIEF DESCRIPTION OF THE DRAWINGS

The invention will be explained in more detail below by means of exemplary embodiments in conjunction with the drawings, in which.

DETAILED DESCRIPTION

Figure 1:
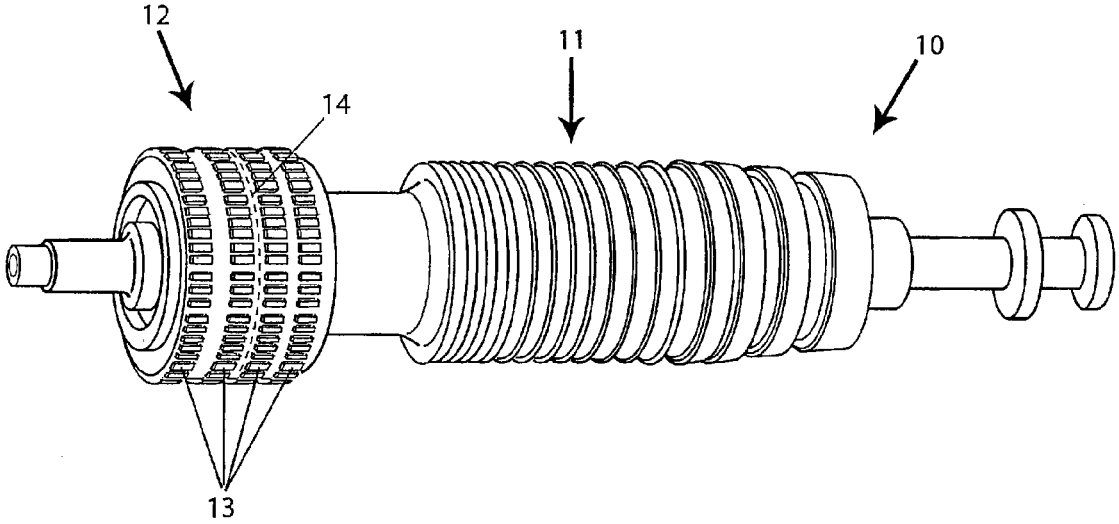
FIG. 1 shows a perspective side view of a rotor shaft (without blading) with cooling air ducts in the turbine part according to an exemplary embodiment of the present invention.
Figure 5:
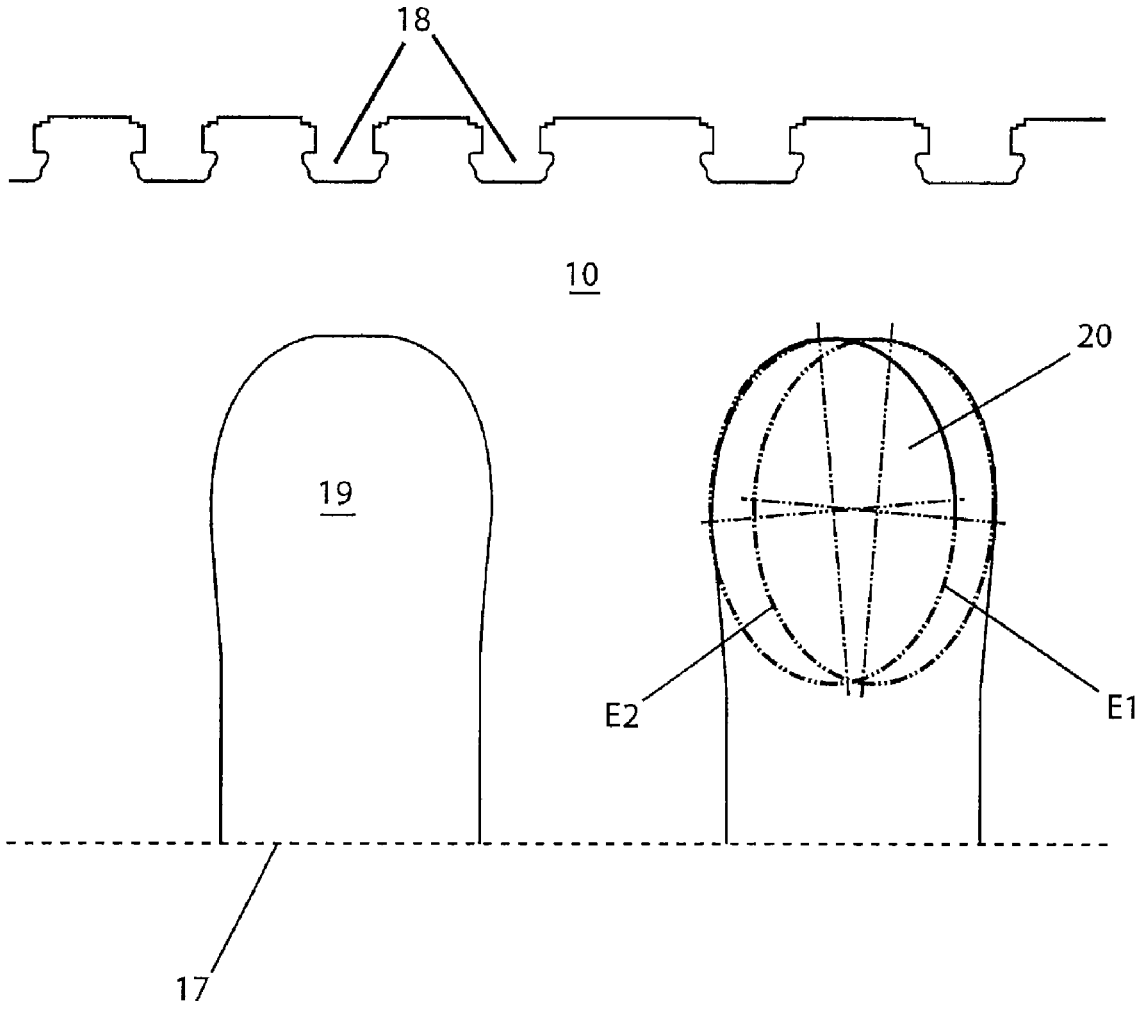
FIG. 5 shows, in longitudinal section, a rotor shaft with inner cavities which, according to another exemplary embodiment of the invention, are provided on the outer circumference with a partially elliptic cross-sectional contour.

FIG. 1 reproduces a perspective side view of a rotor shaft 10 (without blading) of a gas turbine. The rotor shaft 10, rotationally symmetric with respect to the rotor axis (17 in FIG. 2), is subdivided into a compressor part 11 and a turbine part 12. Between the two parts 11 and 12, inside the gas turbine, the combustion chamber is arranged, into which the air compressed in the compressor part 11 is introduced and out of which the hot gas flows through the turbine part 12. The turbine part 12 has, arranged one behind the other in the axial direction, a plurality of rotor disks 13, in which, according to FIG. 3, 4, axially oriented reception slots 21 for the reception of corresponding moving blades are formed so as to be distributed over the circumference. The blade roots are held in the reception slots 21 in the customary way by positive connection by means of a pinetree-like cross-sectional contour. According to FIG. 5, in the compressor part 11, circumferential grooves 18 running around are provided, in which the blading of the compressor part is fastened.

Figure 2:
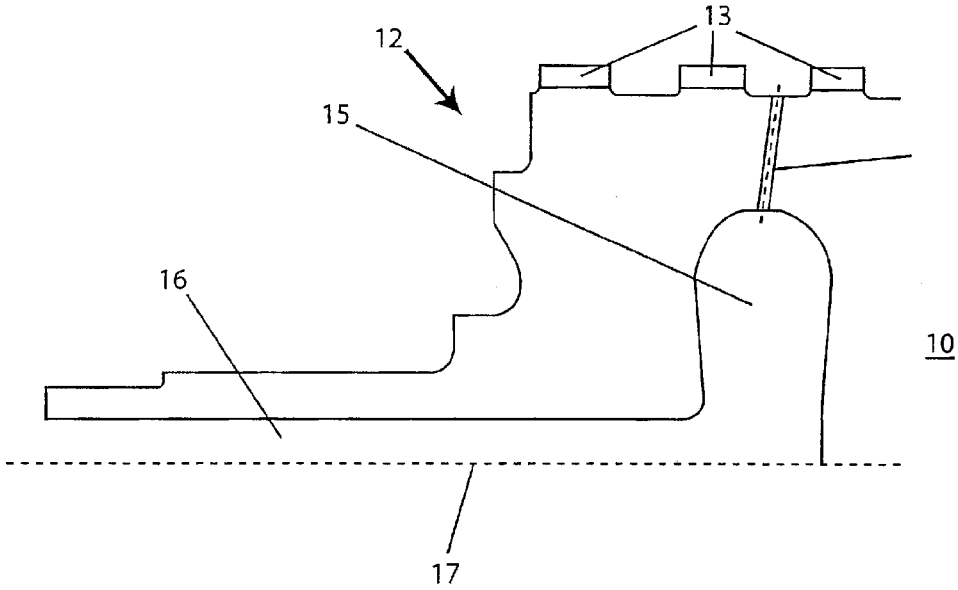
FIG. 2 shows a longitudinal section through the rotor shaft from FIG. 1 in the region of the turbine part.
Figure 3:
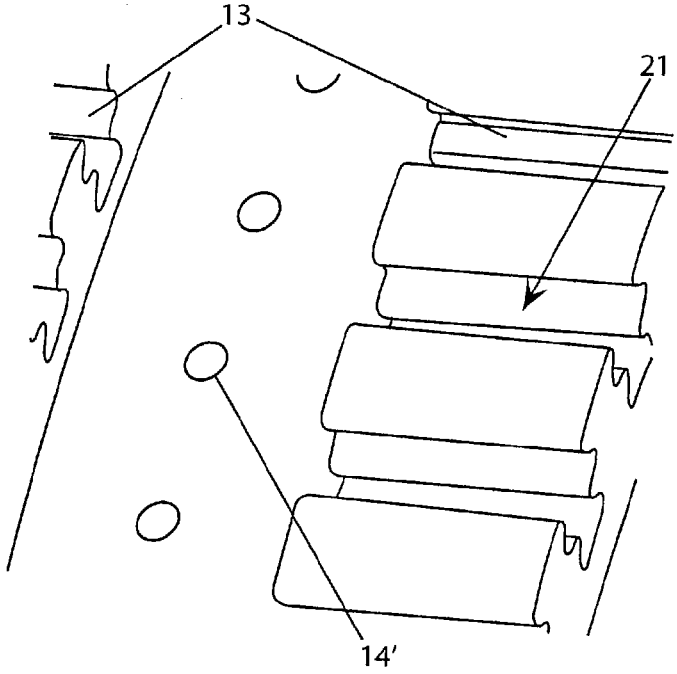
FIG. 3 shows a view of the turbine part of a rotor shaft, said turbine part being equipped with conventional cooling air ducts.

In the turbine part 12 subjected to high thermal load, a multiplicity of cooling air ducts 14 are provided, distributed over the circumference, between adjacent rotor disks, which cooling air ducts emanate approximately radially outward from a cavity 15 formed inside the rotor shaft 10 and issue into the outside space on the surface of the rotor shaft 10 (FIG. 2). The cavity 15 is connected to a central cooling air supply 16 running in the axial direction. Whereas, in earlier designs (FIG. 3), the cooling air ducts (14') had a circular cross section, in the novel configuration of FIG. 4 the cooling air ducts 14 have an elliptic cross section for reasons of mechanical stability. The elliptic cross section of the cooling air ducts 14 may be predetermined even during the casting of the rotor shaft. It is also conceivable, however, to introduce such a cross section into the rotor shaft 10 by means of special machining methods, such as erosion.

Figure 4:
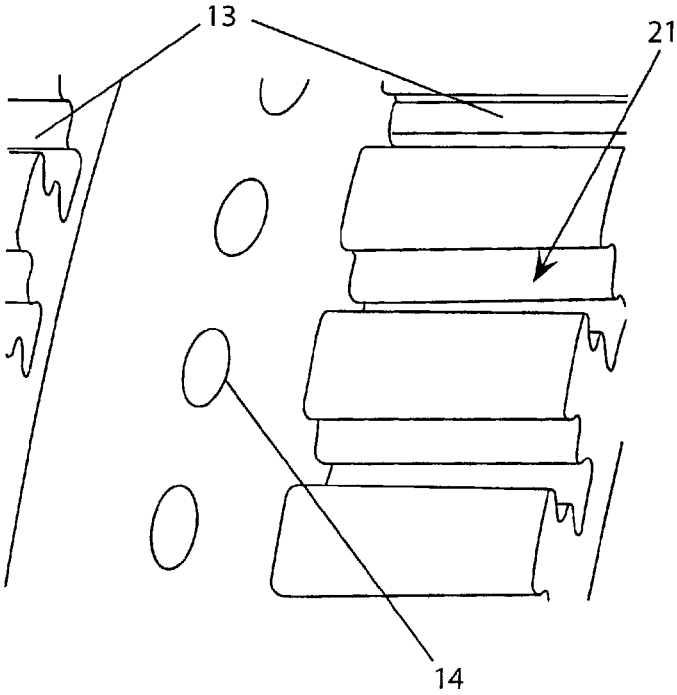
FIG. 4 shows an illustration, comparable to FIG. 3, of a rotor shaft according to an exemplary embodiment of the invention.

As can be seen clearly in FIG. 4, the ellipses of the duct cross section of the cooling air ducts 14 are oriented such that the major axes are oriented in the circumferential direction, while the minor axes lie parallel to the rotor axis 17. A maximum reduction of the mechanical stresses is thereby achieved. It goes without saying that the advantages of an elliptic cross section are not restricted to cooling air ducts in the rotor shaft itself, but also apply to cooling air ducts which are arranged on other parts of the rotor, such as moving blades or the like.

The cavity 15 formed concentrically with respect to the rotor axis 17 is likewise optimized in its cross-sectional profile in terms of the mechanical stresses which arise. The optimization of the cross-sectional profile takes place in the way illustrated in FIG. 5 in further cavities 19, 20 in the compressor part 11, in such a way that the edge contour on the outer circumference of the cavity 15, 19, 20 is at least partially of elliptic design. In particular, as is illustrated for the cavity 20 in FIG. 5, the cross-sectional contour on the outer circumference is composed of two elliptic segments of two ellipses E1, E2 (depicted by dashes in FIG. 5) which are tilted with respect to one another and the major axes of which are oriented approximately in the radial direction. Such a shaping of the cavities present inside the rotor shaft 10 is not only advantageous in connection with the cooling air ducts 14 in the turbine part, but may also be used in other cavities 19, 20 which are located, for example, in the compressor part 11 of the rotor shaft 10.

What is claimed is:

1. A rotor shaft comprising:

a cooling air supply disposed inside the rotor shaft; and a plurality of cooling air ducts connected to the cooling air supply and extending essentially radially outward to an outside of the shaft, wherein each of the cooling air ducts has an elliptic cross section;

wherein the rotor shaft has a compressor part and a turbine part, and wherein the plurality of cooling air ducts are arranged in the turbine part; and wherein the turbine part includes a plurality of rotor disks arranged adjacent to one other in an axial direction of the shaft, the rotor disks configured to fasten moving blades, and wherein the cooling air ducts are arranged between adjacent ones of the rotor disks.

2. The rotor shaft as recited in claim 1, wherein the plurality of cooling air ducts are arranged so as to be distributed over a circumference of the rotor shaft, and wherein the elliptic cross section of each cooling air duct includes a major axis and a minor axis and is oriented such that the major axis is oriented in a circumferential direction and the minor axis is oriented in an axial direction of the rotor shaft.

3. The rotor shaft as recited in claims 1, further comprising at least one cavity formed inside the rotor shaft concentrically with respect to the rotor axis, wherein the cooling air ducts emanate from the at least one cavity and wherein the at least one cavity connects the cooling ducts to the cooling air supply.

4. The rotor shaft as recited in claim 3, wherein the cavities have an at least partially elliptic cross-sectional contour at an outer circumference.

5. The rotor shaft as recited in claim 4, wherein the cross-sectional contour on the outer circumference is composed of segments of two ellipses that are tilted with respect to one another and having major axes oriented approximately in the radial direction.

6. The rotor shaft as recited in claim 1, wherein the rotor shaft is gas turbine rotor shaft.

7. A rotor shaft comprising:

a cooling air supply disposed inside the rotor shaft; and a plurality of cooling air ducts connected to the cooling air supply and extending essentially radially outward toward an outside of the shaft, wherein each of the cooling air ducts has an elliptic cross section;

at least one cavity formed inside the rotor shaft concentrically relative to the rotor axis, the cooling ducts emanating from the at least one cavity, wherein the at least one cavity connects the cooling ducts to the cooling air supply and wherein the cavity has an at least partially elliptic cross-sectional contour at an outer circumference of the cavity.

8. The rotor shaft as recited in claim 7, wherein the cross-sectional contour includes segments of two ellipses tilted relative to one another and having major axes oriented in a substantially radial direction.

9. The rotor shaft as recited in claim 7, wherein the rotor shaft is a gas turbine rotor shaft.

10. The rotor shaft as recited in claim 7, wherein the plurality of cooling ducts are arranged so as to be distributed over a circumference of the rotor shaft and wherein the elliptic cross section of each cooling air duct includes a major axis oriented in a circumferential direction and a minor axis oriented in an axial direction of the rotor shaft.

11. The rotor shaft as recited in claim 7, wherein the rotor shaft includes a compressor part and a turbine part and wherein the plurality of cooling air ducts is arranged in the turbine part of the rotor shaft.

12. The rotor shaft as recited in claim 11, wherein the turbine part includes a plurality of rotor disks arranged adjacent to one another in an axial direction of the shaft, the rotor disks configured to fasten moving blades and wherein the cooling air ducts are arranged between adjacent ones of the rotor disks.

* * * * *